United States Patent [19]

Dusek et al.

[11] Patent Number: 4,606,357

[45] Date of Patent: Aug. 19, 1986

[54] TOBACCO COMPOSITION

[76] Inventors: Russell L. Dusek, 3 Middle Patent Rd., Armonk, N.Y. 10504; Robert J. Posten, 236 Glen Ave., Glen Rock, N.J. 07452

[21] Appl. No.: 672,800

[22] Filed: Nov. 19, 1984

[51] Int. Cl.[4] ..... A24B 15/00; A24B 15/10

[52] U.S. Cl. ..... 131/359; 131/369

[58] Field of Search ..... 131/359, 366, 367, 369, 131/361

[56] References Cited

U.S. PATENT DOCUMENTS 3,903,232 9/1975 Wood et al. ..... 264/357

4,233,993 11/1980 Miano et al. ..... 131/359

OTHER PUBLICATIONS

Hypol ®, Laboratory Procedures and Foam Formulations by W. R. Grace & Co. 1/1981.

Hypol Plus TM, Laboratory Procedures and Foam Formulations by W. R. Grace & Co. 1/1981.

*Primary Examiner*—V. Millin

*Attorney, Agent, or Firm*—Cohen, Pontani & Lieberman

[57] ABSTRACT

A chewable resilient tobacco flavor containing composition having a three-dimensional network is disclosed. The tobacco flavor impregnated composition is intended for use as a smokeless tobacco and composed of a reaction product of a non-toxic hydrophilic polyurethane prepolymer, an aqueous reactant and tobacco flavor and/or natural tobacco.

15 Claims, No Drawings

TOBACCO COMPOSITION

TECHNICAL FIELD

The present invention relates to a tobacco-flavor containing composition and particularly to a resilient composition for use as a smokeless tobacco containing a foamed hydrophilic polyurethane and tobacco.

BACKGROUND ART

Snuff and chewing tobacco as an effective alternative to the smoking of cigarettes, cigars or pipes have been known for more than a century. However, due to an ever increasing aversion by the general public against smoking, chewing tobacco has recently gained new interest.

To render chewing tobacco more acceptable to the user in terms of cleanliness and aesthetics, the need to confine loose cut tobacco in packages or otherwise has been recognized. Thus, for reasons such as to prevent crumbs of tobacco from being scattered about the mouth of the user, tobacco has been manufactured in cartridges or charges of defined proportions. To prevent the loose tobacco from coming into contact with the lips, gums and/or tongue of the user, chewing tobacco has been covered with a porous and elastic substance as disclosed in U.S. Pat. Nos. 805,806 or 1,376,586. Also, to preserve the moisture content and natural aroma of tobacco, it is known from U.S. Patent No. 189,604 to cover the individual tobacco plugs with a gelatinous covering layer. It has also been proposed to enclose tobacco into fabric or paper pouches. Finally, U.S. Pat. No. 4,317,837 discloses a product made from chewing gum and tobacco.

In accordance with the present invention, there is provided a chewable and resilient composition of a tobacco flavor impregnated hydrophilic polyurethane foam which is placed between the cheek and the gum of the user.

DISCLOSURE OF THE INVENTION

The present invention relates to a tobacco flavor containing composition, and particularly to a resilient tobacco flavor containing composition which is composed of a particular foamable hydrophilic prepolymer, a water reactant and tobacco flavor. As is explained in more detail below, the particular foamable hydrophilic or water absorbent prepolymer utilized in the present invention is prepared from an isocyanate terminated or capped polyoxyethylene polyol which is commercially available under the trademark HYPOL® from W. R. Grace & Co. To induce and effect the foaming of the prepolymer to form a three dimensional structural network, the hydrophilic prepolymer is intimately mixed with large volumes of aqueous reactant. Surfactants, flavors, fillers, texturizers and/or softening agents may be added either separately or to the aqueous reactant or the hydrophilic prepolymer. Protic additives which will react with the isocyanate component must, however, be added to the aqueous reactant. Thus, as the term "aqueous reactant" is used herein, it includes water and aqueous solutions and/or slurries of water and the above-mentioned additives.

In addition, known blowing agents such as water, isocyanates, isothiocyanates, halocarbons, fluorocarbons, fluorohalocarbons, pentane and air may also be utilized.

The amount of aqueous reactant, including the above-mentioned additives, as well as the reaction temperature, are generally not critical but will vary with the desired properties such as foam density, foaming time, the aesthetic appearance of the finished product, and cell structure, including stength and porosity thereof.

The reaction is appropriately carried out approximately slightly above room temperature, although as indicated, a wide temperature range may be used. In general, temperatures above 50° C. may cause the product to collapse while temperatures below 18° C. could result in a large number of closed cells.

Prior to foaming, the tobacco flavor is added to the water reactant or is intimately admixed with the prepolymer or added as a separate component. Agitation during the foaming process provides for cell uniformity and even distribution of tobacco flavor throughout the three dimensional network of the foam during formation thereof. The term "tobacco flavor" as used herein is understood to include dry or moist snuff natural tobacco, tobacco substitutes, and synthetic tobacco flavor such as 2,4,6-triisobutyl-1,3,5-trioxane disclosed in U.S. Pat. No. 4,092,752.

The production of the foamable hydrophilic prepolymer useful in the present invention is set forth in U.S. Pat. No. 4,137,200, the disclosure of which is incorporated herein by reference. In addition to the tolylene diisocyanate (TDI) derived prepolymer described in the above-referred to U.S. Patent, the polyoxyethylene polyol reactant used in the present invention may also be terminated with other suitable cyanates, particularly with methylene diphenyl diisocyanate (MDI). The MDI derived prepolymer is commercially available from W. R. Grace & Co. under the trademark HYPOL PLUS TM. MDI derived prepolymer is the preferred foamable hydrophilic prepolymer component of the instant invention since its water extractibles were found to be less than 0.3%. MDI derived products are thus considered to be non-toxic and non-mutagenic.

Upon contact with saliva in the mouth of the user, products made from the MDI terminated polyol reactant will swell less and have better hydrolytic stability than products made from TDI capped polyol reactants. In water, TDI derived compositions typically swell 50–100%, while MDI derived compositions swell 10–60%.

The pH of the water reactant influences the rate of foam formation and should thus preferably be in the range of about 5.0–7.0 although tobacco flavor containing compositions can be produced satisfactorily within a range of from about 4.0 to about 8.0.

The tobacco flavor-containing hydrophilic composition of the present invention can be formed by extruding, cutting or molding into any desired shape. For example, the tobacco flavor impregnated composition can be molded into individual pillow-shaped products for insertion into the mouth between the cheek and the gum of the user. Thus, although the user has the pleasure and sensation of natural tobacco, the tobacco or snuff particles are prevented from being scattered about the mouth of the user or from being lodged between the teeth or in the cavities of the user's mouth. Moreover, tobacco particles are prevented from entering the lungs of the user. In addition, the product of the instant invention is clean and easy to use thereby preventing the accumulation of tobacco dust in the user's pocket and obviating the necessity of pinching or biting off pieces of a chunk of chewing tobacco.

BEST MODE FOR CARYING OUT THE INVENTION

The tobacco flavor impregnated product of the present invention is conveniently prepared by reacting the isocyanate terminated prepolymer with the water reactant containing the tobacco flavor. It is important that the capping or termination of the polyoxyethylene polyol is performed in a way so that the resulting isocyanate terminated prepolymer has an isocyanate functionality of greater than 2 and that substantially all of the reactive hydroxy groups have been capped. If water is the sole reactant, i.e. the reaction is performed without additional blowing agents and/or surfactants, the isocyanate terminated polyoxyethlene polyol must have an isocyanate functionality of greater than 2 to about 8 or more. The polyol reactant prior to capping has a weight average molecular weight of about 200 to about 20,000 and preferably between about 600 to about 6,000, with a hydroxyl functionality of about 2 or greater, preferably from out 2 to about 8.

The polyisocyanates useful in the present invention include, but are not limited to, tolylene diisocyanate, methylene diphenyl diisocyanate and mixtures thereof. Further examples of isocyanates which may be employed are disclosed in the above-referred to U.S. Pat. No. 4,137,200. As to the preparation of the hydrophilic prepolymer, we again refer to the above-mentioned U.S. patent. The product of the invention may contain MDI derived hydrophilic prepolymer in an amount of from 0% to 100% by weight, i.e. the MDI/TDI ratio can be from 0:100 to 100:0.

The polyol reactant is meant to include not only homopolymers of ethylene oxide but also hydrophilic copolymers of ethylene oxide. It is important that the polyol reactant has a hydroxyl functionality of about 2 or greater and an ethylene oxide content of from about 40 mole percent to about 100 mole percent and preferably greater than about 55 mole percent. To insure the formation of a three dimensional network, the amount of capped polyoxyethylene polyol having an isocyanate functionality of greater than two should be in the range of from about 3% by weight to about 100% by weight of polyol. Accordingly, it is possible to include into the product of the present invention of from 0% to about 97% by weight of a diisocyanate capped polyol, i.e. one having an isocyanate functionality of two.

As mentioned previously, the water reactant can be used either neat or as a mixture with the tobacco flavor and one or more of the aforementioned additives such as surfactants, blowing agents, flavors, fillers, softening agents and the like.

Lower reaction temperatures will result in denser foams with coarser cell structure while higher temperatures will produce less dense foams having a finer cell structure. Temperature variations may also accelerate or retard the foaming process. In general, however, the product of the invention when made at room temperature will expand, set and become tack free in about 5 minutes. Thus, the aqueous reactant has a temperature of from about 50° F. to about 120° F. and preferably of from about 85° F. to about 105° F. and the HYPOL PLUS TM reactant has a temperature of from about 70° F. to about 130° F. and preferably from about 85° F. to about 105° F.

The aqueous reactant is generally employed in ratios of about 5% to about 95% by weight of the composition. Preferably, ratios of aqueous reactant to HYPOL of from about 0.5–5 to about 1–2.5 parts of water to polymer have been found to give satisfactory results. As the temperature of the reactants influence the properties of the final product, so does the amount of aqueous reactant. If minimum foam expansion is desired, the amount of water added is reduced accordingly. Insufficient amounts of water will increase closed cell formation. Thus, the amounts of water used in the present invention ranges from about 6.5 mole water per mole NCO groups to about 390 moles of water per mole NCO groups. This corresponds to a $H_2O$ Index Value of from about 1300 to about 18,000 and preferably from about 4,000 to about 40,000 corresponding to about 20 to about 200 moles of water per mole NCO groups.

The tobacco component can be added either moist or dry in any suitable form and is preferably finely cut tobacco, or fine grade snuff. The tobacco can be added to the hydrophilic prepolymer, to the water component, or can be separately added during the foaming process, such as by sprinkling the fine grade snuff, under agitation, on the prepolymer/water composition during the foaming process. Irrespective of the manner in which the tobacco flavor is added to the prepolymer, agitation of the mixture during the foaming process ensures even distribution of the tobacco in the final product.

As mentioned, the rate of foam formation is further influenced by the pH of the aqueous reactant. In general, conducting the reaction of the components within the extreme acidic or basic pH range may result in a complete failure of the foaming reaction. Thus, while a pH range of the water reactant within the range of from about 4.0 to about 8.0 will produce a satisfactory product, it is preferred to perform the foaming reaction within a pH range of from about 5.0 to about 7.0. As with the determination of the optimum $H_2O$/-prepolymer ratio, the optimum pH value is best determined by testing.

Although the tobacco impregnated product of the present invention can be prepared by merely admixing the prepolymer with the tobacco flavor containing water reactant, the addition of surfactant to the reaction mixture may greatly improve the cell structure of the final product. Thus, the choice of a suitable surfactant may affect the density and strength of the foam as well as the degree of hydrophilicity. Examples of surfactants suitable for use herein include, but are not limited to, surfactants which, for example, decrease the hydrophilicity of the foam, such as fatty esters and silicones. Nonionic surfactants, such as the commercially available surfactants PLURONIC TM (BASF Wyandotte) are preferred and are usually employed in an amount of from 0% to about 5.0%. The surfactant is preferably soluble in the aqueous reactant. It is to be noted that the performance of the surfactant can be affected by the reaction temperature, the mixing efficiencies, the ratios of the respective reactants, the viscosities thereof and the mold design.

The composition of the invention may contain additional flavoring such as synthetic flavors and oils derived from plants, leaves, flowers, fruit, etc. Flavors which may be used in the present invention include, but are not limited to, essential oils such as peppermint oil, spearmint oil, oil of wintergreen and mixtures thereof.

Suitable fillers and texturizers for use herein include, but are not limited to, calcium carbonate, aluminum hydroxide, alumina, magnesium carbonate, dicalcium phosphate, talc (3 MgO.4 $SiO_2$. $H_2O$), cellulose, magnesium trisilicate, magnesium hydroxide, aluminum silicates and combinations thereof. Softening agents and sweetners suitable for use in the present invention include, but are not limited to, corn syrup, polyvinylacetate, vinylesters, vinylethers, xylitol, sorbitol, manitol, cyclamates, aspartame, and saccharine.

The fillers, texturizers, sweetners, and/or softening agents are employed herein in an amount of from 0% to about 20%.

Blowing agents other than water are usually not required. However, if additional blowing agents are employed in the present invention, blowing agents conventionally used in urethane technology may be utilized. Examples of suitable blowing agents include, but are not limited to, isocyanates, isothiocyanates, aromatic diisocyanates, halocarbons, fluorocarbons, fluorohalocarbons, pentane and compressed air. The amount of blowing agent employed herein ranges from about 0% to about 20%.

The tobacco flavor containing product of the present invention can be formed into any desired shape such as by cutting the foamed product or by molding the tobacco containing hydrophilic foam in suitable molds. Suitable material for making molds include, but are not limited to, wood and plaster, aluminum, polyethylene, TEFLON®, silicone, rubber and epoxy.

Mold release agents may be applied to the mold surface prior to use in the foaming process. Suitable molds release agents are applied by brushing, spraying, soaking or the like, and include, but are not limited to, lubricants such as paraffin waxes, silicones, fluorocarbons. The mold release agents employed herein should be inert, i.e. should not alter desired foam properties such as hydrophilicity or toxicity.

If desired, a skin can be formed covering the surface of the tobacco containing composition which is exposed to the surface of the mold. In general, the use of a cold mold results in thick and smooth skin formation. Heating the mold up to about 110° F. to about 130° F. results in thinner skin of open cell structure. The addition of a mold release agent to the heated mold produces only little skin formation. Molded products are suitably produced by a one shot technique, i.e. the deposition of newly foaming layer on already cured or curing layers should be avoided.

The preferred embodiment of the present invention is further explained in the following examples, in which all parts and percentages are given by weight unless otherwise indicated:

EXAMPLE 1

46.5% of finely cut tobacco is introduced, under stirring into 39.6% of water. The tobacco/water slurry is added, under agitation, to 13.9% of methylenediphenyl diisocyanate (MDI) derived hydrophilic prepolymer (HYPOL PLUS TM, FHP 4000) at room temperature. After 15 seconds of stirring, the tobacco containing composition is poured into molds. Within about 5 minutes, the tobacco impregnated foam expands, sets and becomes tack free.

EXAMLE 2

46.5% of finely cut tobacco and 3.0% of wintergreen are introduced, under stirring, into 36.1% of water. 0.5% of the surfactant PLURONIC® L62 is added to the aqueous reactant. The aqueous reactant is thereafter added under agitation to 13.9% of methylenediphenyl diisocyanate (MDI) derived prepolymer (HYPOL PLUS TM, FHP 4000) at room temperature. After 15 seconds of stirring, the tobacco containing composition is poured into molds. Within 5 minutes, the tobacco impregnated foam expands, sets and becomes tack free.

It should be understood that the preferred embodiments and examples described above are for illustrative purposes only and are not to be construed as limiting the scope of the invention which is properly delineated in the appended claims.

What is claimed is:

1. A smokeless tobacco compositon comprising a resilient composition having a three-dimensional network comprising a hydrophilic foamable polyurethane prepolymer, an aqueous reactant and tobacco flavor.

2. The composition of claim 1, wherein the polyurethane prepolymer comprises an isocyanate terminated polyoxyethlene polyol.

3. The composition of claim 2, wherein the isocyanate is methylenediphenyl diisocyanate.

4. The composition of claim 2, wherein the isocyanate is toluene diisocyanate.

5. The composition of claim 1, wherein the tobacco flavor is derived from natural tobacco.

6. The composition of claim 1, wherein the tobacco flavor is derived from synethic tobacco flavoring.

7. The composition of claim 1, wherein the tobacco flavor is derived from moist or dry snuff.

8. The composition of claim 1, wherein the tobacco flavor is derived from tobacco substitutes.

9. The composition of claim 5, wherein the natural tobacco is fine cut tobacco.

10. The composition of claim 1, further comprising a surfactant.

11. A smokeless tobacco composition comprising a resilent composition having a three dimensional network comprising tobacco flavor, water and an isocyanate terminated foamable hydrophilic polyoxyethylene polyol reactant having an isocyanate functionality greater than 2 and including terminated polyoxyethylene polyol having an isocyanate functionality of 2 in an amount of from 0% up to 97% by weight of the polyol, the polyol reactant having a weight average molecular weight of about 200 to about 20,000 and a hydroxyl functionality of about 2 to about 8; and wherein the $H_2O$. Index Value of said polyol and water is about 1,300 to about 78,000.

12. A method of producing a resilient smokeless tobacco composition having a three-dimensional network comprising admixing a foamable hydrophilic polyurethane prepolymer, an aqueous reactant and tobacco flavor.

13. The method of claim 12, wherein the prepolymer comprises an isocyanate terminated foamable hydrophilic polyoxyethylene polyol reactant having an isocyanate functionality greater than 2 and including terminated polyoxyethylene polyol having an isocyanate functionality of 2 in an amount of from 0% up to 97% by weight of the polyol, the polyol reactant having a weight average molecular weight of about 200 to about 20,000 and a hydroxyl functionality of about 2 to about 8; and wherein the $H_2O$. Index Value of said polyol and water is about 1,300 to about 78,000.

14. The method of claim 13, wherein the tobacco flavor is derived from moist or dry snuff.

15. The method of claim 13, wherein the tobacco flavor is derived from fine cut tobacco.

* * * * *